US010067472B2

(12) United States Patent
Rossier

(10) Patent No.: US 10,067,472 B2
(45) Date of Patent: Sep. 4, 2018

(54) WATCH HAND

(71) Applicant: UNIVERSO S.A., La Chaux-de-Fonds (CH)

(72) Inventor: Gerard Rossier, La Chaux-de-Fonds (CH)

(73) Assignee: Universo S.A., La Chaux-de-Fonds (CH)

( * ) Notice: Subject to any disclaimer, the term of this patent is extended or adjusted under 35 U.S.C. 154(b) by 0 days.

(21) Appl. No.: 15/502,045

(22) PCT Filed: Aug. 10, 2015

(86) PCT No.: PCT/EP2015/068383
§ 371 (c)(1),
(2) Date: Feb. 6, 2017

(87) PCT Pub. No.: WO2016/026730
PCT Pub. Date: Feb. 25, 2016

(65) Prior Publication Data

US 2017/0227931 A1 Aug. 10, 2017

(30) Foreign Application Priority Data

Aug. 21, 2014 (EP) ..... 14181733

(51) Int. Cl.
*G04B 19/04* (2006.01)
*G04B 19/02* (2006.01)

(52) U.S. Cl.
CPC ..... *G04B 19/044* (2013.01); *G04B 19/042* (2013.01); *G04B 19/02* (2013.01); *G04B 19/04* (2013.01)

(58) Field of Classification Search
CPC ..... G04B 19/044; G04B 19/02; G04B 19/04; G04B 19/042; G04B 13/021; G04D 3/0046; Y10T 428/24273; Y10T 74/19
USPC ..... 368/238
See application file for complete search history.

(56) References Cited

U.S. PATENT DOCUMENTS 7,438,465 B2 * 10/2008 Bitterli ..... G04B 19/042 368/322
7,572,050 B2 * 8/2009 Bitterli ..... G04B 13/026 368/322
7,618,183 B2 * 11/2009 Meister ..... B81C 99/008 368/322

(Continued)

FOREIGN PATENT DOCUMENTS

EP 1 921 518 A1 5/2008
JP 52-154262 U 11/1977
JP 55-97421 U 7/1980

OTHER PUBLICATIONS

International Search Report dated Jan. 18, 2016 in PCT/EP2015/068383 filed Aug. 10, 2015.

*Primary Examiner* — Edwin A. Leon
(74) *Attorney, Agent, or Firm* — Oblon, McClelland, Maier & Neustadt, L.L.P.

(57) ABSTRACT

A pointer hand for a watchmaking part including a body and a cannon configured to be driven onto a cylindrical arbor, the cannon having an internal diameter that is greater than the diameter of the cylindrical arbor. The cannon includes a flat on its internal diameter that is configured to cooperate with the cylindrical arbor, to elastically deform the cannon on both sides of the flat to fix the hand onto the cylindrical arbor.

11 Claims, 2 Drawing Sheets

(56) References Cited

U.S. PATENT DOCUMENTS

| | | | | |
|---|---|---|---|---|
| 9,678,477 | B2 * | 6/2017 | Tanabe | G04B 13/02 |
| 2008/0113154 | A1 | 5/2008 | Bitterli et al. | |

* cited by examiner

WATCH HAND

FIELD OF THE INVENTION

The invention relates to the horological field and, more specifically, to watch hands.

BACKGROUND OF THE INVENTION

In general, the timekeeping hands in watchmaking parts are fixed onto their rotational arbor by driving, i.e. a hollow cylinder, in this case the cannon, is forced onto an arbor with a diameter that is slightly greater than the internal diameter of the cylinder. The elastic and plastic properties of the material that is employed, generally a metal, are used for this driving operation. Thus, it is possible for a hollow cylinder to be driven onto a conventional rotational arbor, such as those that are used in mechanical horology, with a difference in diameter of several microns.

Furthermore, fixing a hand must provide a force that is sufficient to be able to retain the hand in place in the event of impacts. The force needed for a conventional timekeeping hand is approximately 10 N, for example.

In order to overcome these problems, it has already been proposed for the hands to be produced with a cannon having one or more slots that are parallel to the rotational arbor and are open at the end opposite the hand so that the cannon deforms elastically. Such an example of fixing is particularly disclosed in document EP 1659460.

The timekeeping hand described above has several disadvantages. Firstly, it is to be noted that the slots on the cannon weaken this cannon, which involves producing extremely thin slots so as not to excessively weaken the cannon. It is also to be noted that complex machining operations are involved in obtaining the finest possible slots, whilst complying with the width and the length required to obtain the desired driving force, which involves an increase in production costs and time.

SUMMARY OF THE INVENTION

The particular object of the invention is to overcome the various disadvantages of these known techniques.

More specifically, one object of the invention is to provide a timekeeping hand that is more robust with respect to the tolerances involved when driving on the hand.

A further object of the invention, at least in one particular embodiment, is to provide a timekeeping hand that requires a lower driving force, whilst maintaining a satisfactory force for retaining the hand on the arbor.

These objects, as well as others that will become more clearly apparent hereafter, are achieved according to the invention using a pointer hand for a watchmaking part comprising a cannon of cylindrical shape, having an internal diameter Di, that is intended to be driven onto a cylindrical arbor.

According to the invention, said cannon has at least one flat on its internal diameter that is intended to cooperate with said cylindrical arbor, so as to elastically deform the cannon on both sides of said at least one flat in order to fix said cannon onto said cylindrical arbor.

According to further advantageous variants of the invention:

said at least one flat is positioned in the immediate vicinity of the plate;

said at least one flat extends over all or part of the height of said cannon;

the thickness of said at least one flat is identical to the thickness of said cannon;

the internal defined between said at least one flat and the circular wall of said cannon—is less than the diameter of said cylindrical arbor;

said cannon and said plate are two distinct elements;

said cannon and said plate form a one-piece element;

said cannon and said plate are produced from a metal alloy such as a copper alloy, a gold alloy, a steel alloy or also an aluminium alloy.

The invention further relates to a watchmaking part equipped with a movement comprising a hand extension formed by a cylindrical arbor and a pointer hand according to the invention, the cylindrical arbor having a diameter that is substantially less than the internal diameter of the cannon, so as to elastically retain the hand on the hand extension.

Therefore, the object of the present invention, by virtue of its various functional and structural aspects described above, allows a watch hand to be obtained that is more robust and is easier to drive onto an arbor.

BRIEF DESCRIPTION OF THE DRAWINGS

Further features and advantages of the invention will become more clearly apparent upon reading the following description of a particular embodiment of the invention, which is provided by way of a simple, non-limiting illustrative example, and with reference to the accompanying drawings, in which.

DETAILED DESCRIPTION OF THE PREFERRED EMBODIMENTS

Figure 1:
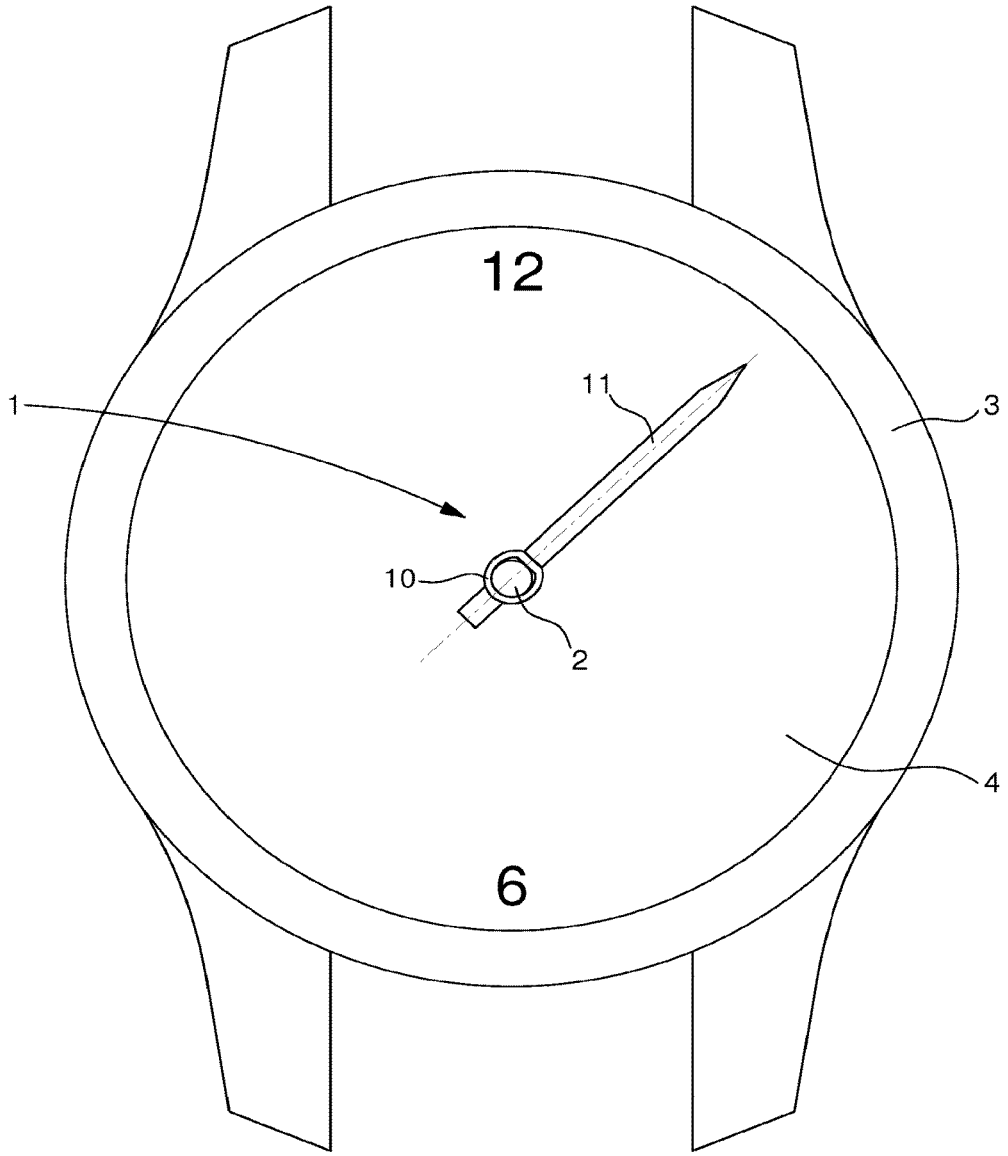
FIG. 1 shows a watchmaking part equipped with a pointer hand according to the invention.

A pointer hand according to one embodiment will now be described hereafter with joint reference to FIGS. 1, 2, 3 and 4.

As previously mentioned, the general principle of the invention is based on the use of a pointer hand 1 for a watchmaking part conventionally comprising a body 11 and a cannon 10 that is intended to be driven onto a cylindrical arbor 2, the cannon 10 having an internal diameter Di that is greater than the diameter Dax of the cylindrical arbor 2.

The body 11 and the cannon 10 can be equally formed by stamping, chip removal machining, laser machining, blanking by punching or any other machining operation that is known to persons skilled in the art.

According to a first embodiment of the invention, the cannon 10 and the body 11 of the hand 1 are two distinct elements, the cannon being added to the body 11 when the hand is assembled.

According to a second embodiment of the invention, the cannon 10 and the body 11 form a one-piece element.

The body 11 and the cannon 10 of the hand 1 can be produced from metal alloys such as copper alloys like brass, bronze or also Pfinodal, gold alloys, aluminium alloys or also steel alloys. Clearly, in the event that the cannon 10 is added to the body 11 of the hand 1, the body 11 and the cannon 10 can be produced from a different alloy, for example the body 11 can be produced from a gold alloy and the cannon 10 can be produced from a steel alloy.

Clearly, any other type of alloy that is known to persons skilled in the art for manufacturing hands can be contemplated.

According to the invention, the cannon 10 is of cylindrical shape and has at least one flat 12 on its internal diameter Di that is intended to cooperate with the cylindrical arbor 2, so as to elastically deform the cannon 10 on both sides of the flat 12 in order to retain the cannon 10 in place on the cylindrical arbor 2.

Preferably, the flat 12 is positioned in the immediate vicinity of the body 11 of the hand 1, along the centre line Am of the hand 1. Such a position of the flat 12 particularly allows a hand 1 to be obtained with a better aesthetic appearance. The flat 12 clearly can be positioned anywhere on the internal diameter of the cannon 10.

According to a further embodiment of the invention, not shown in the Figs., the cannon can have a plurality of flats on its internal diameter.

For the sake of clarity and of understanding, the embodiment that will be described hereafter is of the cannon with a single flat on its internal diameter.

Figure 2:
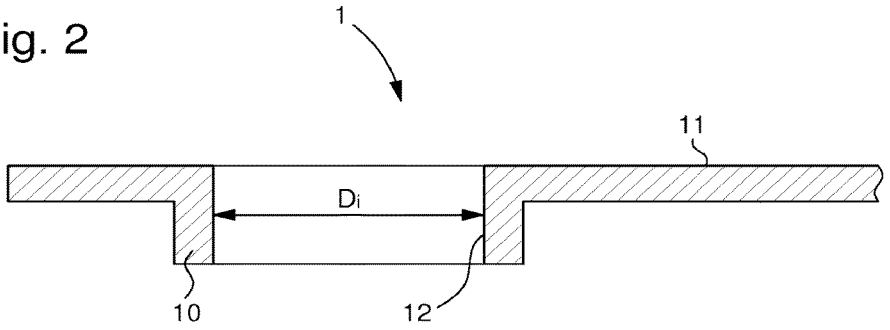
FIG. 2 shows a section view of a pointer hand according to the invention.

According to the invention, the flat 12 extends over all or part of the height of the cannon 10. As shown in FIG. 2, the flat 12 extends over the entire height of the cannon 10.

Figure 3:
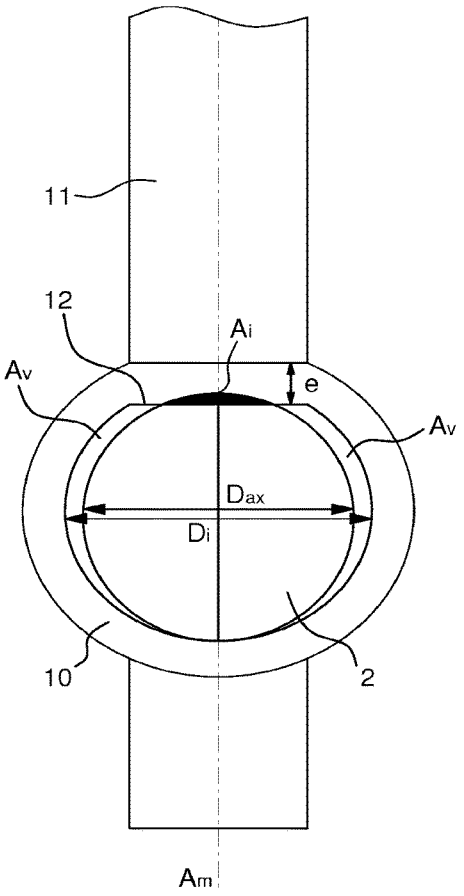
FIG. 3 shows a top view of a pointer hand according to the invention before it is driven onto a cylindrical arbor.

According to the non-limiting embodiment shown in FIG. 3, the thickness e of the flat 12 is identical to the thickness of the cannon 10 in order to obtain a better aesthetic appearance. However, the thickness e of the flat can vary depending on the requirements and the feasibility, the thickness e of the flat 12 can be less than or greater than that of the cannon 10.

As can be seen in FIG. 3, the distance between the flat 12 and the wall opposite the flat 12 is less than the diameter Dax of the cylindrical arbor 2 in order to create an interference.

As shown in FIG. 3, the cannon has, in the vicinity of the body 11, a flat 12 that locally reduces the internal diameter Di of the cannon 10 such that the diameter Dax of the cylindrical arbor 2 is greater than the diameter Di of the cannon 10 in the vicinity of the flat 12.

Thus, the distance between the flat 12 and the wall opposite the flat 12 of the cannon 10 is less than the diameter Dax of the cylindrical arbor, which allows an interference to be created that is between 10 μm and 16 μm.

By virtue of this feature, the flat 12 elastically grips the cannon 10 on the cylindrical arbor 2.

Indeed, when the cannon 10 is driven onto the cylindrical arbor 2, the cylindrical arbor 2 exerts a force on the flat 12 and separates it from its initial position, the effect of which is to deform the walls of the cannon 10 that are located on both sides of the flat 12. Thus, the cannon 10 adapts to the dimensions of the cylindrical arbor 2 and retains the hand 1 on the cylindrical arbor 2, whilst requiring a lower driving force yet maintaining a satisfactory force for retaining the hand 1 on the cylindrical arbor. The term satisfactory is understood to mean a sufficient retention force for keeping the hand 1 in place in the event of impacts and which is also sufficient for being able to adjust its position. Such a hand is also more robust with respect to the tolerances when driving on the hand, with the cannon 10 not having any slots that are susceptible to weaken it.

According to the observations of the inventor, such a hand 1 according to the invention only requires a driving force between 10 N and 25 N, which represents a lower force compared to the prior art, where the driving force is 10 N for an interference of 1 μm.

Figure 4:
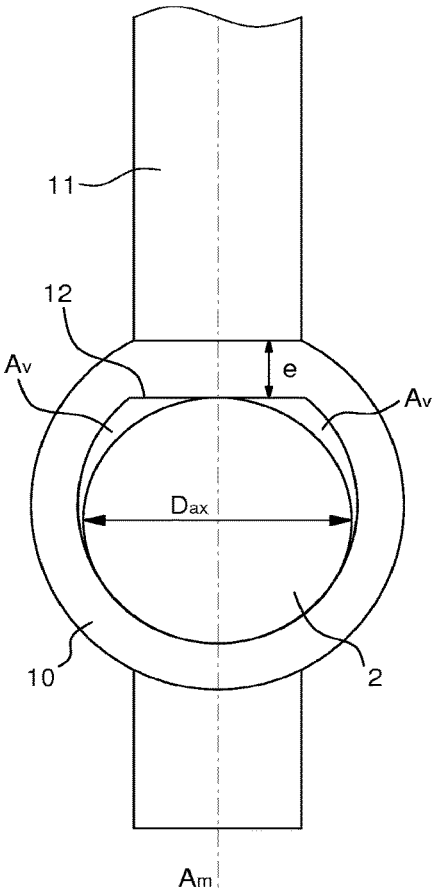
FIG. 4 shows a top view of a pointer hand according to the invention driven onto a cylindrical arbor.

As can be seen in FIG. 3, the intersection between the flat 12 and the cylindrical arbor 2 represents an area called "interference area" Ai and the free space between the cylindrical arbor 2 and the walls of the cannon 10 represents an area called "empty area" Av. The interference area Ai always will be higher than zero and will be designed so that the required force for driving on and/or for retaining the hand 1 is achieved according to the rigidity of the geometry of the cannon 10. The empty area Av is variable and tends to reduce when the cylindrical arbor 2 is introduced into the cannon 10, as shown in FIG. 4.

Thus, in order for the deformations of the cannon 10 to remain within the elastic range, it is important to ensure that the empty area Av less the interference area Ai is equal to, or is greater than, zero.

As can be seen in FIG. 1, the pointer hand according to the invention equips a watch, the watch particularly comprising a watch case 3 equipped with a movement superposed by a dial 4, through which a hand extension is formed by the cylindrical arbor 2, the pointer hand 1 being elastically retained on said cylindrical arbor 2.

By virtue of these various aspects of the invention, a more robust and easy to mount watch hand is provided that also provides good retention on its arbor.

Of course, the present invention is not limited to the example shown and is susceptible to various variants and modifications that will become apparent to persons skilled in the art.

NOMENCLATURE

1. Hand
10. Cannon
11. Body
12. Flat
2. Cylindrical arbor
3. Watch casing
4. Dial
Di. Internal cannon diameter
Dax. Arbor diameter
Av. Empty area
Ai. Interference area
Am. Centre line
e. Flat thickness

The invention claimed is:

1. An assembly comprising:

a hand extension including a cylindrical arbor and a pointer hand for a watchmaking part including a body and a cannon of cylindrical shape, having an internal diameter, that is configured to be driven onto the cylindrical arbor of diameter, wherein an interior wall of the cannon is circular except for at least one flat that is configured to cooperate with the cylindrical arbor, and the internal diameter of the cannon measured between the at least one flat and a portion of interior wall that is circular is less than the diameter of the cylindrical arbor, to elastically deform the cannon on both sides of the at least one flat to fix the hand onto the cylindrical arbor.

2. The assembly according to claim 1, wherein the at least one flat is positioned in an immediate vicinity of the body of the hand.

3. The assembly according to claim 1, wherein the at least one flat extends over all of a height of the cannon.

4. The assembly according to claim 1, wherein thickness of the cannon in a vicinity of the at least one flat is identical to thickness of the cannon.

5. The assembly according to claim 1, wherein the cannon and the body of the hand are distinct elements.

6. The assembly according to claim 1, wherein the cannon and the body of the hand form a one-piece element.

7. The assembly according to claim 1, wherein the cannon and the body of the hand are produced from a metal alloy, a copper alloy, a gold alloy, a steel alloy, or an aluminium alloy.

8. A watchmaking part comprising:

a movement including the assembly according to claim 1.

9. The assembly according to claim 1, wherein the at least one flat extends over part of a height of the cannon.

10. The assembly according to claim 1, wherein the cannon does not have any slots within the cylinder shape.

11. An assembly comprising:

a hand extension including a cylindrical arbor and a pointer hand for a watchmaking part including a body and a cannon of cylindrical shape, having an internal diameter, that is configured to be driven onto the cylindrical arbor of diameter, wherein an interior wall of the cannon is circular except for a single flat that is configured to cooperate with the cylindrical arbor, and the internal diameter of the cannon measured between the single flat and a portion of interior wall that is circular is less than the diameter of the cylindrical arbor, to elastically deform the cannon on both sides of the single flat to fix the hand onto the cylindrical arbor.

* * * * *